US012590698B2

(12) United States Patent
Theuer et al.

(10) Patent No.: US 12,590,698 B2
(45) Date of Patent: Mar. 31, 2026

(54) MULTI-TUBE BURNER SYSTEM FOR EFFICIENT MIXING OF FUEL AND AIR FOR COMBUSTION

(71) Applicant: Sustainable Business & Engineering Solutions GmbH, Untersiggenthal (CH)

(72) Inventors: Andre Theuer, Baden (CH); Naresh Kumar Aluri, Untersiggenthal (CH); Panduranag Reddy Alemela, Turgi (CH); Suresh Munivenkatareddy, Bengaluru (IN); Rahul Singh Chauhan, Delhi (IN)

(73) Assignee: Sustainable Business & Engineering Solutions GmbH, Untersiggenthal (CH)

( * ) Notice: Subject to any disclaimer, the term of this patent is extended or adjusted under 35 U.S.C. 154(b) by 341 days.

(21) Appl. No.: 18/455,679

(22) Filed: Aug. 25, 2023

(65) Prior Publication Data

US 2024/0068659 A1 Feb. 29, 2024

(51) Int. Cl.
*F23D 11/24* (2006.01)
*F23D 14/64* (2006.01)
(Continued)

(52) U.S. Cl.
CPC ..... *F23D 11/24* (2013.01); *F23D 14/64* (2013.01); *F23D 23/00* (2013.01); *F23K 5/06* (2013.01);
(Continued)

(58) Field of Classification Search
CPC ..... F23D 14/24; F23D 14/64; F23D 14/22; F23D 14/78; F23D 14/58; F23D 23/00; F23K 5/06
(Continued)

(56) References Cited

U.S. PATENT DOCUMENTS 698,519 A * 4/1902 Kent ..... F23D 11/10 431/174
747,312 A * 12/1903 Axtell ..... F23D 11/10 431/174
(Continued)

FOREIGN PATENT DOCUMENTS

EP 2206954 A2 7/2010
JP 2010286232 A 12/2010

OTHER PUBLICATIONS https://www.sciencedirect.com/science/article/abs/pil/S0360319908011956; vol. 34, Issue 1, Jan. 2009, pp. 496-506; Dynamics, NOx and flashback characteristics of confined premixed hydrogen-enriched methane flames; O. Tuncer, S. Acharya, J.H. Uhm.

(Continued)

*Primary Examiner* — Vivek K Shirsat
(74) *Attorney, Agent, or Firm* — Jason C. Cameron

(57) ABSTRACT

A multi-tube burner system for efficient mixing of fuel and air for combustion is disclosed. The multi-tube burner system includes an air supply plenum, a multi-tube burner, and a combustor. Further, the multi-tube burner includes a set of tubes including the air supply section to receive combustion air and supply the received combustion air to a mixing section. Furthermore, the multi-tube burner includes a set of fuel pipes to receive fuel from a set of fuel inlets and supply the received fuel to a set of fuel plenums. Furthermore, a pair of fuel receiving channels receive the fuel from the set of fuel plenums and a fuel injector pin injects the received fuel from the pair of fuel receiving channels to the mixing section. Further, a set of mixing holes allow egression of the combustion air and the fuel mixture from the mixing section to the combustor.

10 Claims, 6 Drawing Sheets

(51) Int. Cl.
*F23D 23/00* (2006.01)
*F23K 5/06* (2006.01)

(52) U.S. Cl.
CPC ..... *F23D 2202/00* (2013.01); *F23D 2213/00* (2013.01); *F23D 2214/00* (2013.01)

(58) Field of Classification Search
USPC ..... 431/160, 174
See application file for complete search history.

(56) References Cited

U.S. PATENT DOCUMENTS 749,251 A * 1/1904 Allen ..... F23D 14/04 239/587.5
1,319,839 A * 10/1919 Buhler ..... F23D 17/00 431/174
1,729,447 A * 9/1929 McKee ..... F23D 14/64 431/350
1,962,237 A * 6/1934 Dodge ..... F23D 99/004 239/455
4,610,625 A * 9/1986 Bunn ..... F23Q 3/008 431/351
5,100,313 A * 3/1992 Anderson ..... F23D 14/20 431/159
5,554,021 A * 9/1996 Robertson ..... F23C 3/00 431/278
5,833,447 A * 11/1998 Bodelin ..... F23D 14/22 431/174
6,062,848 A * 5/2000 Lifshits ..... F23C 9/006 239/428
6,638,057 B2 * 10/2003 Watson ..... F23D 14/22 431/174
6,928,823 B2 * 8/2005 Inoue ..... F23R 3/36 60/737
7,163,392 B2 * 1/2007 Feese ..... F23C 6/045 431/187
8,763,399 B2 * 7/2014 Dodo ..... F23R 3/343 60/737
9,303,873 B2 4/2016 Stewart et al.
10,253,977 B2 4/2019 Goh et al.
2003/0108834 A1 * 6/2003 Pelton ..... F23D 14/32 431/187
2005/0048430 A1 * 3/2005 Steiner ..... F23D 11/44 431/278
2007/0298356 A1 * 12/2007 Rangmark ..... F23D 14/22 431/181
2008/0268387 A1 * 10/2008 Saito ..... F23R 3/286 431/174
2010/0167054 A1 * 7/2010 Hagihara ..... F23D 14/32 431/185
2011/0294080 A1 * 12/2011 Horn ..... F23D 14/78 431/181
2013/0189630 A1 * 7/2013 Ching ..... F23C 6/047 431/174
2013/0309618 A1 * 11/2013 Horn ..... F23D 14/58 431/181
2015/0040579 A1 * 2/2015 Melton ..... F23R 3/283 431/181
2016/0178206 A1 * 6/2016 Yoshino ..... F23R 3/045 239/408
2016/0238241 A1 * 8/2016 Rousseau ..... F23D 14/24

OTHER PUBLICATIONS https://www.sciencedirect.com/science/article/abs/pii/S0360319917306122; Investigation of a pure hydrogen fueled gas turbine burner; Alessandro Cappelletti, Francesco Martelli; vol. 42, Issue 15, Apr. 13, 2017, pp. 10513-10523.
https://www.sciencedirect.com/science/article/abs/pii/S036031992100207X; Flame stabilization mechanisms and shape transitions in a 3D printed, hydrogen enriched, methane/air low-swirl burner; Qiang An a c, Sina Kheirkhah b, Jeffrey Bergthorson c, Sean Yun a, Jeongjae Hwang d, Won June Lee d, Min Kuk Kim d, Ju Hyeong Cho d, Han Seok Kim d, Patrizio Vena; vol. 46, Issue 27, Apr. 19, 2021, pp. 14764-14779.

* cited by examiner

MULTI-TUBE BURNER SYSTEM FOR EFFICIENT MIXING OF FUEL AND AIR FOR COMBUSTION

CROSS REFERENCE TO RELATED APPLICATIONS

This application claims priority from a patent application filed in China having Patent Application No. 202241048875 filed on Aug. 26, 2022 and titled "MULTI-TUBE BURNER SYSTEM FOR EFFICIENT MIXING OF FUEL AND AIR FOR COMBUSTION".

FIELD OF INVENTION

Embodiments of a present disclosure relates to a burner system and more particularly relates to a multi-tube burner system for efficient mixing of fuel and air for combustion.

BACKGROUND

Generally, gaseous burner systems are swirl stabilized for effective mixing and formation of flame stabilization in an inner and an outer shear layer formed due to vortex breakdown phenomenon. However, this results in a very compact flame, which is susceptible to moving upstream or downstream, for variation of fuel and air mixture fractions or the mean mass flow rates based on load of operation. Further, the flashback risk increases for reactive fuels w % ben their turbulence flame speed matches or becomes higher than a mean mixture speed inside a core region. In existing gaseous burner systems, the fuel is injected at high velocities in a relatively lower velocity air stream exiting to the combustor. Due to this, there is an inherent flashback or flame holding risk, that the flame anchors in the wake of fuel jet (low velocity region) and may not be able to flush out, causing the parts getting oxidized due to high temperatures. Furthermore, structural integrity of creating a separate air and fuel plenums for combustion of air and fuel mixture and cooling the parts at the same time is very complex and affects machining parameters. Also, these designs typically use air foils or similar structures to guide the air to form swirling flow field to assist the flame to stabilize. However, such structures create additional pressure drop to the gaseous burner systems, which reduces the performance and ultimately efficiency of the entire system.

Hence, there is a need for an improved burner system with Multi-Tube arrangement for efficient mixing of fuel and air for combustion, in order to address the aforementioned issues.

BRIEF DESCRIPTION

In accordance with one embodiment of the disclosure, a burner system for efficient mixing of fuel and air for combustion is disclosed. The burner system includes an air supply plenum, a multi-tube burner, and a combustor. The air supply plenum is positioned upstream of a multi-tube burner. The air supply plenum is configured to supply combustion air to the multi-tube burner via a set of cylindrical air holes formed on an inlet surface of the multi-tube burner. Further, the inlet surface is located at a proximal edge of the multi-tube burner. The multi-tube burner is positioned between the air supply plenum and a combustor. The multi-tube burner includes a set of tubes located inside the multi-tube burner. Furthermore, each of the set of tubes includes an air supply section and a mixing section. The air supply section of each of the set of tubes is configured to receive the combustion air from the set of cylindrical air holes and supply the received combustion air from the proximal edge of the multi-tube burner to the mixing section. A plurality of fuel injectors are located between the air supply section and the mixing section of the set of tubes. Further, the multi-tube burner includes a set of fuel pipes configured to receive fuel from a set of fuel inlets and supply the received fuel from the proximal edge of the multi-tube burner to a set of fuel plenums. The multi-tube burner also includes the plurality of fuel injectors located inside the set of tubes. Each of the plurality of fuel injectors includes a pair of fuel receiving channels and a fuel injector pin. The pair of fuel receiving channels are configured to receive the fuel from one of: the set of fuel plenums via a set of fuel injector entrances. The fuel injector pin is configured to inject the received fuel from the pair of fuel receiving channels to the mixing section. In an embodiment of the present disclosure, the received fuel is injected in-line with the combustion air present in the mixing section. The mixing section facilitates mixing of the combustion air and the fuel due to in-line injection. Furthermore, the multi-tube burner includes a burner front panel located at a distal edge of the multi-tube burner. The burner front panel includes a set of mixing holes configured to allow egression of the combustion air and the fuel mixture from the mixing section to the combustor. Further, the combustor is positioned downstream of the multi-tube burner. The combustor combusts the combustion air and the fuel mixture to form one or more hot gas products.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated online platform, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or subsystems or elements or structures or components preceded by "comprises . . . a" does not, without more constraints, preclude the existence of other devices, subsystems, elements, structures, components, additional devices, additional subsystems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Figure 1A:
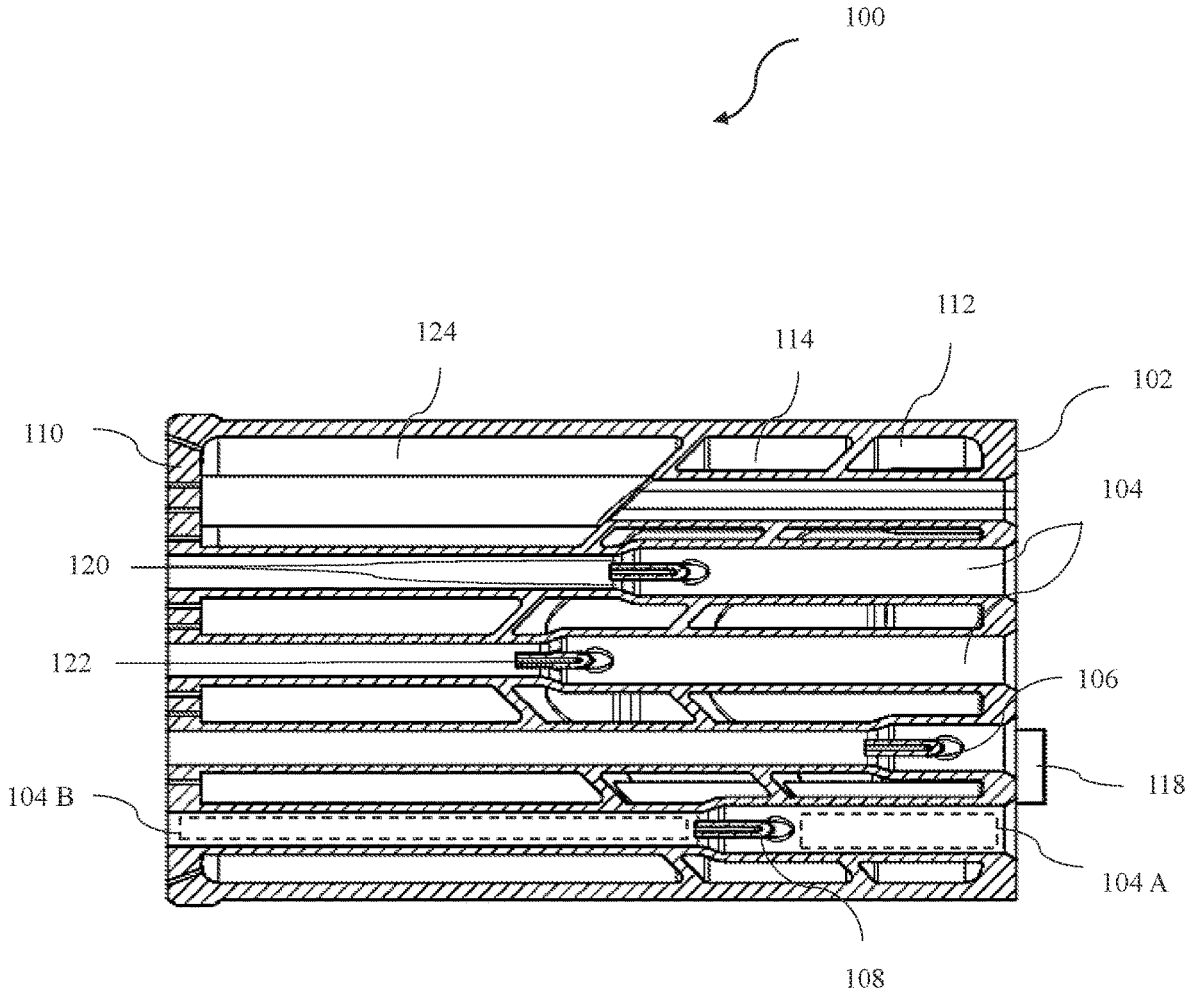
FIG. 1A-1C are cross-sectional views of an exemplary multi-tube burner for efficient mixing of fuel and air for combustion, in accordance with an embodiment of the present disclosure.
Figure 1B:
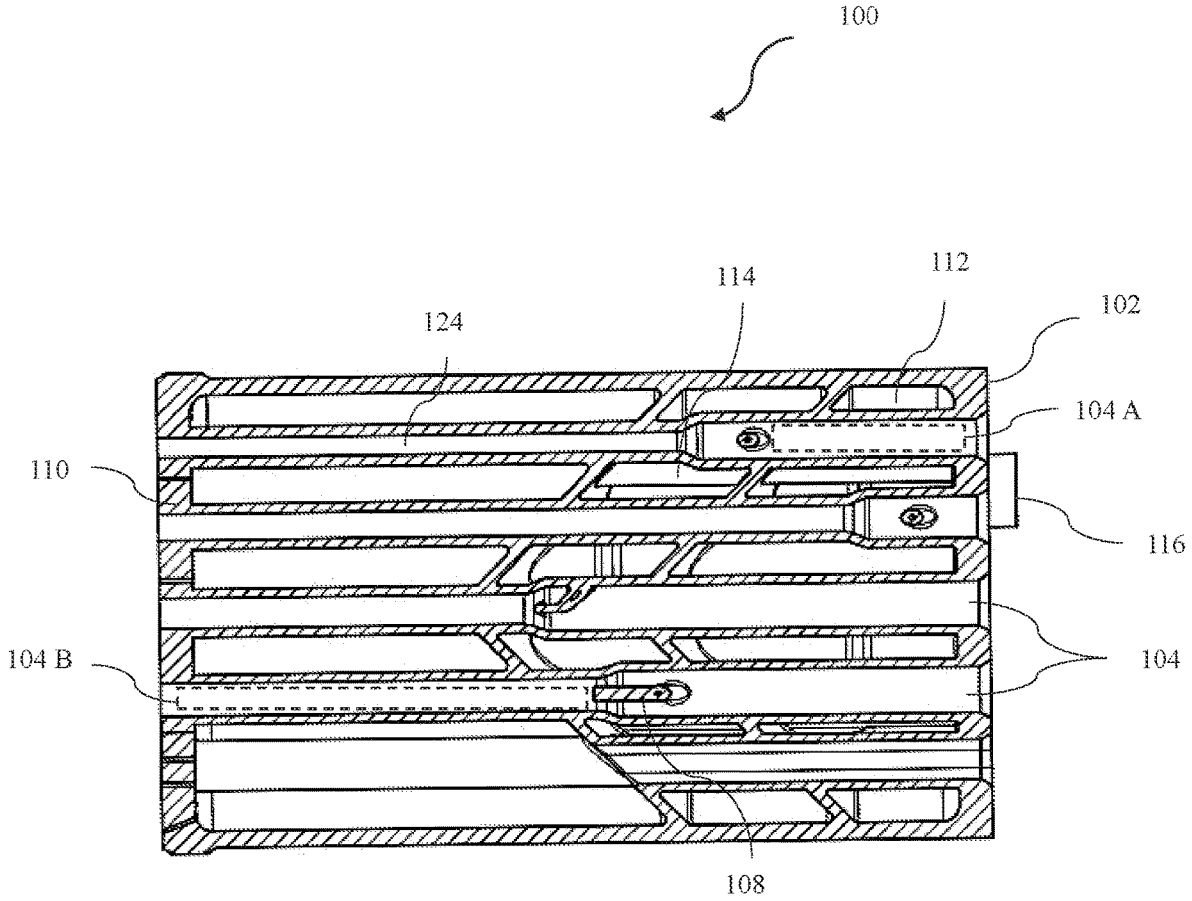
Figure 1C:
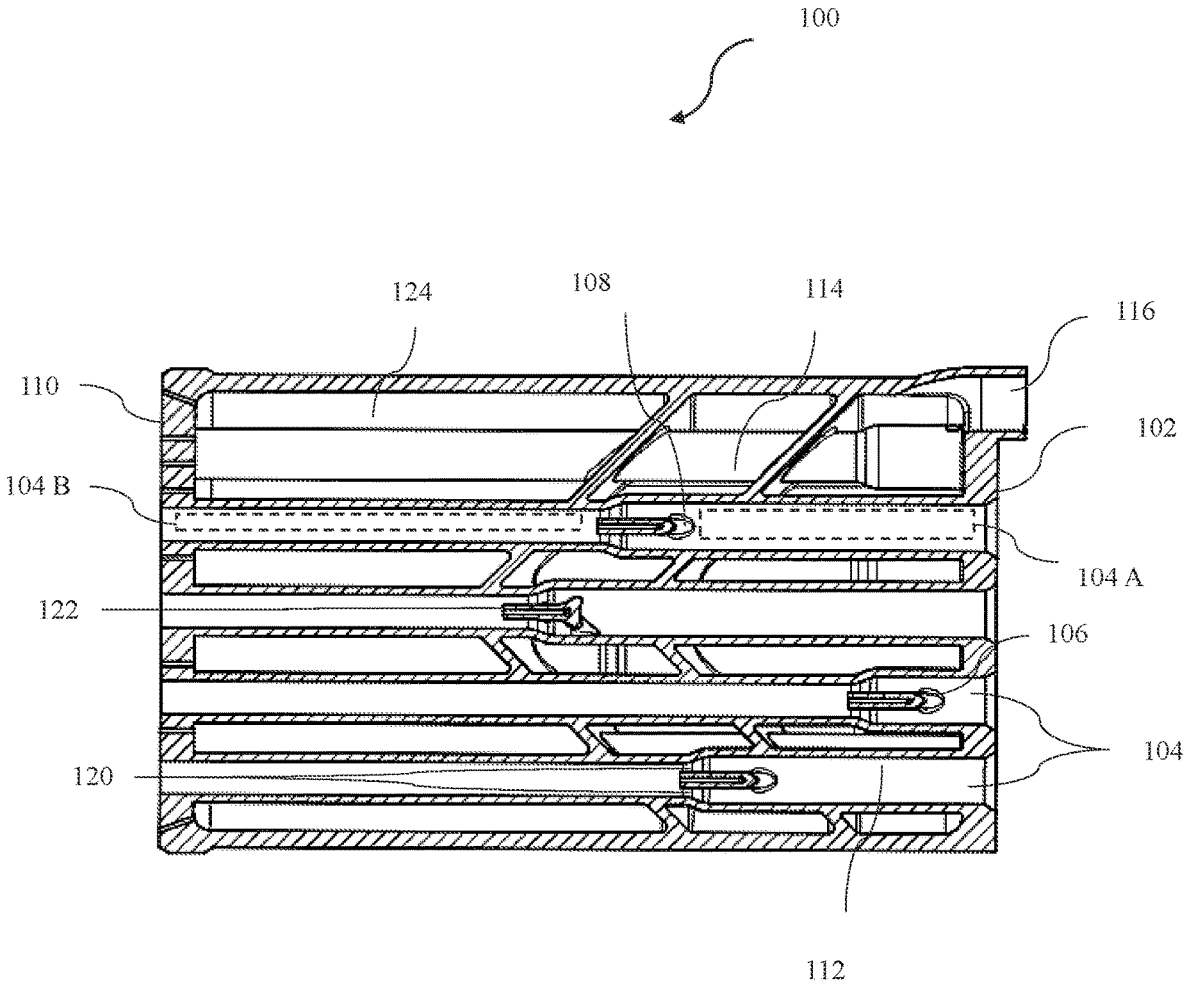

FIGS. 1A-1C are cross sectional views of an exemplary multi-tube burner 100 for efficient mixing of fuel and air for combustion, in accordance with an embodiment of the present disclosure. For the sake of brevity, FIGS. 1A-AC have been explained together. In an embodiment of the present disclosure, a multi-tube burner system includes an air supply plenum, a multi-tube burner 100, and a combustor. Details on the multi-burner system, the air supply plenum, and the combustor have been elaborated in subsequent paragraphs of the present description with reference to FIG. 3. As used herein, the term "multi-tube burner" is a mechanical device which is used to inject right fuel air mixture into a combustor for providing efficient combustion to the combustor.

In an embodiment of the present disclosure, the air supply plenum is positioned upstream of the multi-tube burner 100. The air supply plenum is configured to supply combustion air to the multi-tube burner 100 via a set of cylindrical air holes formed on an inlet surface 102 of the multi-tube burner 100. In an embodiment of the present disclosure, the inlet surface 102 is located at a proximal edge of the multi-tube burner 100. Details on the set of cylindrical air holes have been elaborated in subsequent paragraphs of the present description with reference to FIG. 2A.

Further, the multi-tube burner 100 is positioned between the air supply plenum and the combustor. The multi-tube burner 100 includes a set of tubes 104 located inside the multi-tube burner 100, as shown in FIGS. 1A-1C. In an embodiment of the present disclosure, the set of tubes 104 are distributed in a certain pattern, such as circumferentially or in a rectangular geometry as per the combustor geometric constrains. In an embodiment of the present disclosure, each of the set of tubes 104 includes an air supply section 104 A and a mixing section 104 B. The air supply section 104 A of each of the set of tubes 104 is configured to receive the combustion air from the set of cylindrical air holes and supply the received combustion air from the proximal edge of the multi-tube burner 100 to the mixing section 104 B. In an embodiment of the present disclosure, the combustion air enters in all the set of tubes 104 uniformly and moves from right direction to left direction, as shown in FIGS. 1A-1C. Further, a plurality of fuel injectors are located between the air supply section 104 A and the mixing section 104 B of the set of tubes 104. In an embodiment of the present disclosure, the plurality of fuel injectors include a first set of fuel injectors 106 and a second set of fuel injectors 108, as shown in FIGS. 1A-1C.

In an embodiment of the present disclosure, the plurality of fuel injectors are located inside the set of tubes 104 at different axial positions from each other for optimized mixing and convective time delay. In an embodiment of the present disclosure, length of the mixing section 104 B and the air supply section 104 A of the set of tubes 104 is dependent on position of the plurality of fuel injectors inside the set of tubes 104. When one or more fuel injectors of the plurality of injectors are located in proximity of a burner front panel 110, length of the mixing section 104 B is decreased. In an embodiment of the present disclosure, the burner front panel 110 is located at a distal edge of the multi-tube burner 100. When the one or more fuel injectors are located in proximity of the inlet surface 102, the length of the mixing section 104 B is increased. In an embodiment of the present disclosure, when the length of the mixing section 104 B is increased, the combustion air and the fuel get more time and space to homogeneously mix with each other due to turbulence inside the mixing section 104 B.

Further, the multi-tube burner 100 includes a set of fuel pipes configured to receive fuel from a set of fuel inlets and supply the received fuel from the proximal edge of the multi-tube burner 100 to a set of fuel plenums. In an exemplary embodiment of the present disclosure, the set of fuel pipes includes a first fuel pipe and a second fuel pipe. Furthermore, the set of fuel inlets include a first fuel inlet and a second fuel inlet. The set of fuel plenums include a first fuel plenum 112, and a second fuel plenum 114, as shown in FIGS. 1A-1C. In an exemplary embodiment of the present disclosure, volume of the first fuel plenum 112 is larger as compared to volume of the second fuel plenum 114. Details on the first fuel inlet and the second fuel inlet have been elaborated in subsequent paragraphs of the present description with reference to FIG. 2A.

In an embodiment of the present disclosure, the first fuel pipe is configured to receive the fuel from the first fuel inlet and supply the received fuel from the proximal edge of the multi-tube burner 100 to the first fuel plenum 112. Further, the first fuel inlet is attached with a first fuel feed pipe 116 to receive the fuel, as shown in FIG. 1B and FIG. 1C. In an embodiment of the present disclosure, the second fuel pipe is configured to receive the fuel from the second fuel inlet and supply the received fuel from the proximal edge of the multi-tube burner 100 to the second fuel plenum 114. Furthermore, the second fuel inlet is attached with a second fuel feed pipe 118 to receive the fuel, as shown in FIG. 1A. In an embodiment of the present disclosure, the fuel is fed from two separate pipes i.e., the first fuel pipe and the second fuel pipe, for stage 1 and stage 2 respectively. This creates an opportunity to introduce the fuel into the set of tubes 104 at various axial positions. Further, variable quantities of the fuel are supplied through these two stages. This is a key feature to mitigate the risk of lean blow out and as well as pulsations at variable load (operating thermal power) conditions.

Furthermore, the multi-tube burner 100 includes the plurality of fuel injectors located inside the set of tubes 104. In an embodiment of the present disclosure, each of the plurality of fuel injectors include a pair of fuel receiving channels 120 and a fuel injector pin 122, as shown in FIGS. 1A-1C. In an embodiment of the present disclosure, a pair of fuel feeding channels merge and form into a fuel injector pin. The pair of fuel receiving channels 120 are configured to receive the fuel from a fuel plenum of the set of fuel plenums via a set of fuel injector entrances. Details on the set of fuel injector entrances have been elaborated in subsequent paragraphs of the present description with reference to FIG. 3. Further, the fuel injector pin 122 is configured to inject the received fuel from the pair of fuel receiving channels 120 to the mixing section 104 B, as shown in FIGS. 1A-1C. In an embodiment of the present disclosure, the received fuel is injected in-line with the combustion air present in the mixing section 104 B. Furthermore, the mixing section 104 B facilitates mixing of the combustion air and the fuel due to in-line injection. In an embodiment of the present disclosure, the received fuel is injected in-line with the combustion air to achieve optimal mixing with the combustion air and overall pressure drop performance of the multi-tube burner 100. Also, the in-line injection minimizes flashback risk by avoiding or minimizing any wake regions behind the fuel jets if otherwise introduced in a classical jet in cross flow arrangement. The in-line injection also reduces the pressure drop across the multi-tube burner 100.

Further, each of the first set of fuel injectors 106 is configured to receive the fuel from the first fuel plenum 112 via the pair of fuel receiving channels 120 and inject the received fuel to the mixing section 104 B via the fuel injector pin 122. Furthermore, each of the second set of fuel injectors 108 is configured to receive the fuel from the second fuel plenum 114 via the pair of fuel receiving channels 120 and inject the received fuel to the mixing section 104 B via the fuel injector pin 122. In an embodiment of the present disclosure, the mixing section 104 B of one or more tubes including the first set of fuel injectors 106 is longer as compared to the mixing section 104 B of the one or more tubes including the second set of fuel injectors 108. In an embodiment of the present disclosure, once the fuel is injected in the set of tubes 104, the fuel and combustion air form a combustible mixture before it exits the set of tubes 104 and finally ignited in the combustor. In an embodiment of the present disclosure, the air-fuel mixture velocity may be controlled by adjusting tube size of the set of tubes 104. Details on operation of the first set of fuel injectors 106, second set of fuel injectors 108, pair of fuel receiving channels 120, and the fuel injector pin 122 have been elaborated in subsequent paragraphs of the present description with reference to FIG. 3.

Furthermore, the multi-tube burner 100 includes the burner front panel 110. The burner front panel 110 includes a set of mixing holes configured to allow egression of the combustion air and the fuel mixture from the mixing section 104 B to the combustor. Details on the set of mixing holes have been elaborated in subsequent paragraphs of the present description with reference to FIG. 2B.

Further, the combustor is positioned downstream of the multi-tube burner 100. In an embodiment of the present disclosure, the combustor combusts the combustion air and the fuel mixture to form one or more hot gas products.

In an embodiment of the present disclosure, the multi-tube burner 100 includes a set of cooling air tubes located inside the multi-tube burner 100. The set of cooling air tubes are configured to receive cooling air from the air supply plenum via a set of elliptical air holes formed on the inlet surface 102 and supply the received cooling air from the proximal edge of the multi-tube burner 100 to a cooling air plenum 124, as shown in FIGS. 1A-1C. Details on the set of elliptical air holes have been elaborated in subsequent paragraphs of the present description with reference to FIG. 2A.

Further, the multi-tube burner 100 includes a set of effusion cooling holes formed on the burner front panel 110. The set of effusion cooling holes allow egression of the cooling air from the cooling air plenum 124 to avoid overheating and oxidation of the front panel 110. Details on the set of effusion cooling holes have been elaborated in subsequent paragraphs of the present description with reference to FIG. 2B.

In an embodiment of the present disclosure, the multi-tube burner 100 is fabricated by the method of 3D (Dimensional) printing. In an exemplary embodiment of the present disclosure, the set of tubes 104, the set of fuel plenums, the plurality of fuel injectors, the set of cooling air tubes and their feed are integrated into a single hardware by means of 3D printing. Further, multiple additional safety features, such as flash back detection thermocouple, dynamic pressure sensor for detecting the pulsations and flame monitoring, can be well integrated into the multi-tube burner 100 design. In an embodiment of the present disclosure, the multiple additional safety features are implemented through the set of tubes 104.

Figure 2A:
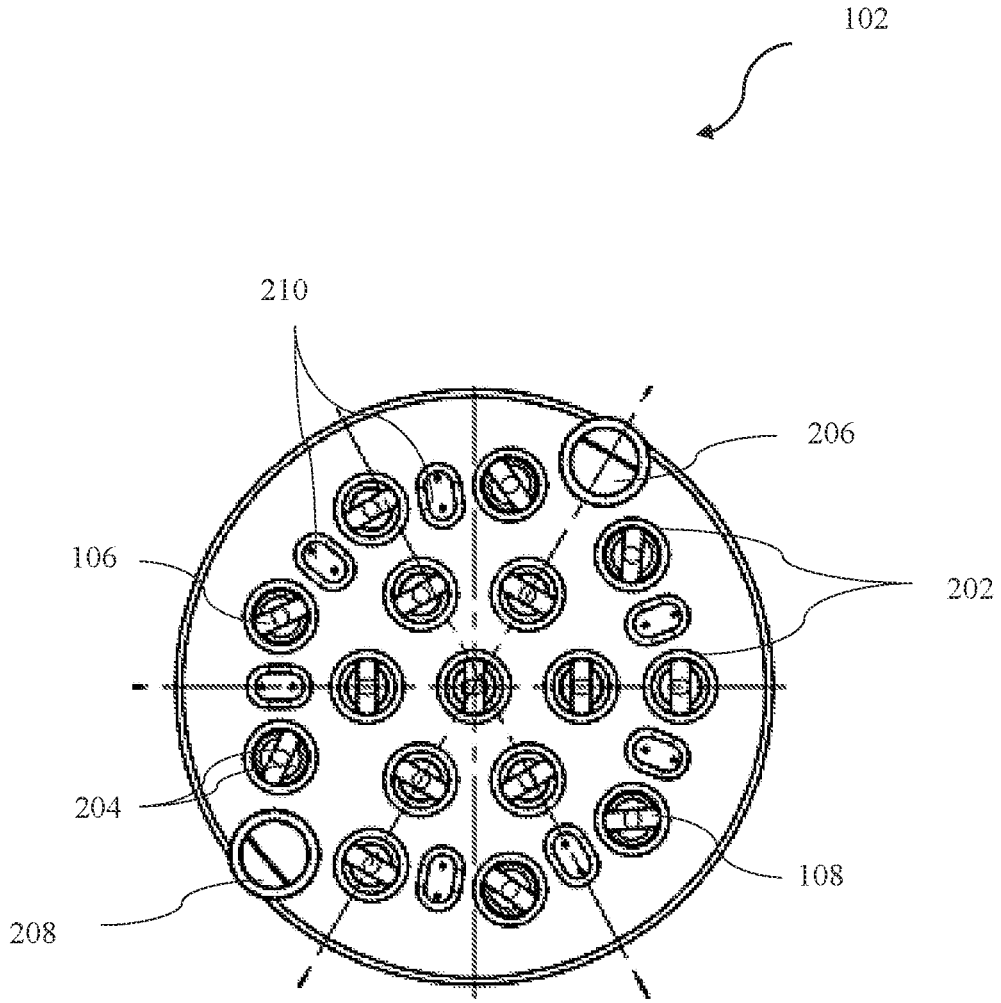
FIG. 2A is a front-view of an exemplary inlet surface, in accordance with an embodiment of the present disclosure.
Figure 2B:
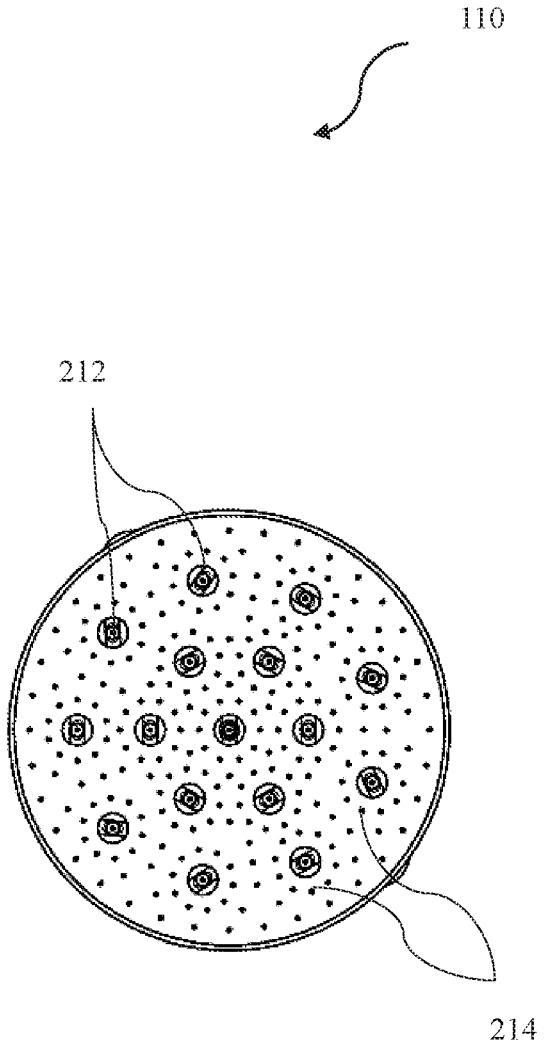
FIG. 2B is a front-view of an exemplary burner front panel, in accordance with an embodiment of the present disclosure.

FIG. 2A is a front-view of an exemplary inlet surface 102, in accordance with an embodiment of the present disclosure. Further, FIG. 2B is a front-view of an exemplary burner front panel 110, in accordance with an embodiment of the present disclosure. For the sake of brevity, FIG. 2A and FIG. 2B have been explained together.

In an embodiment of the present disclosure, the inlet surface 102 includes the set of cylindrical air holes 202 configured to receive the combustion air from the air supply plenum, such that the received combustion air is supplied inside the multi-tube burner 100 via the set of tubes 104, as shown in FIG. 2A. In an embodiment of the present disclosure, the set of air openings 204 inside each of the set of tubes 104 are depicted in FIG. 2A. The set of air openings 204 allow the combustion air to move from the air supply section 104 A to the mixing section 104 B. In an embodiment of the present disclosure, the set of tubes 104 includes the first set of fuel injector and the second set of fuel injector, as shown in FIG. 2A. Further, the inlet surface 102 includes the first fuel inlet 206 and the second fuel inlet 208, as shown in FIG. 2A. The first fuel inlet 206 is configured to receive the fuel from the first fuel feed pipe 116, such that the received fuel is supplied to the first fuel plenum 112 via the first fuel pipe. Furthermore, the second fuel inlet 208 is configured to receive the fuel from the second fuel feed pipe 118, such that the received fuel is supplied to the second fuel plenum 114 via the second fuel pipe. In an embodiment of the present disclosure, the inlet surface 102 includes the set of elliptical air holes 210, as shown in FIG. 2A. The set of elliptical air holes 210 are configured to receive the cooling air from the air supply plenum, such that the received cooling air is supplied to the cooling air plenum 124 via the set of cooling air tubes.

Further, the burner front panel 110 includes the set of mixing holes 212 configured to allow egression of the combustion air and the fuel mixture from the mixing section 104 B to the combustor, as shown in FIG. 2B. The burner front panel 110 also includes the set of effusion cooling holes 214 configured to allow egression of the cooling air from the cooling air plenum 124 to avoid overheating and oxidation of the front panel 110.

Figure 3:
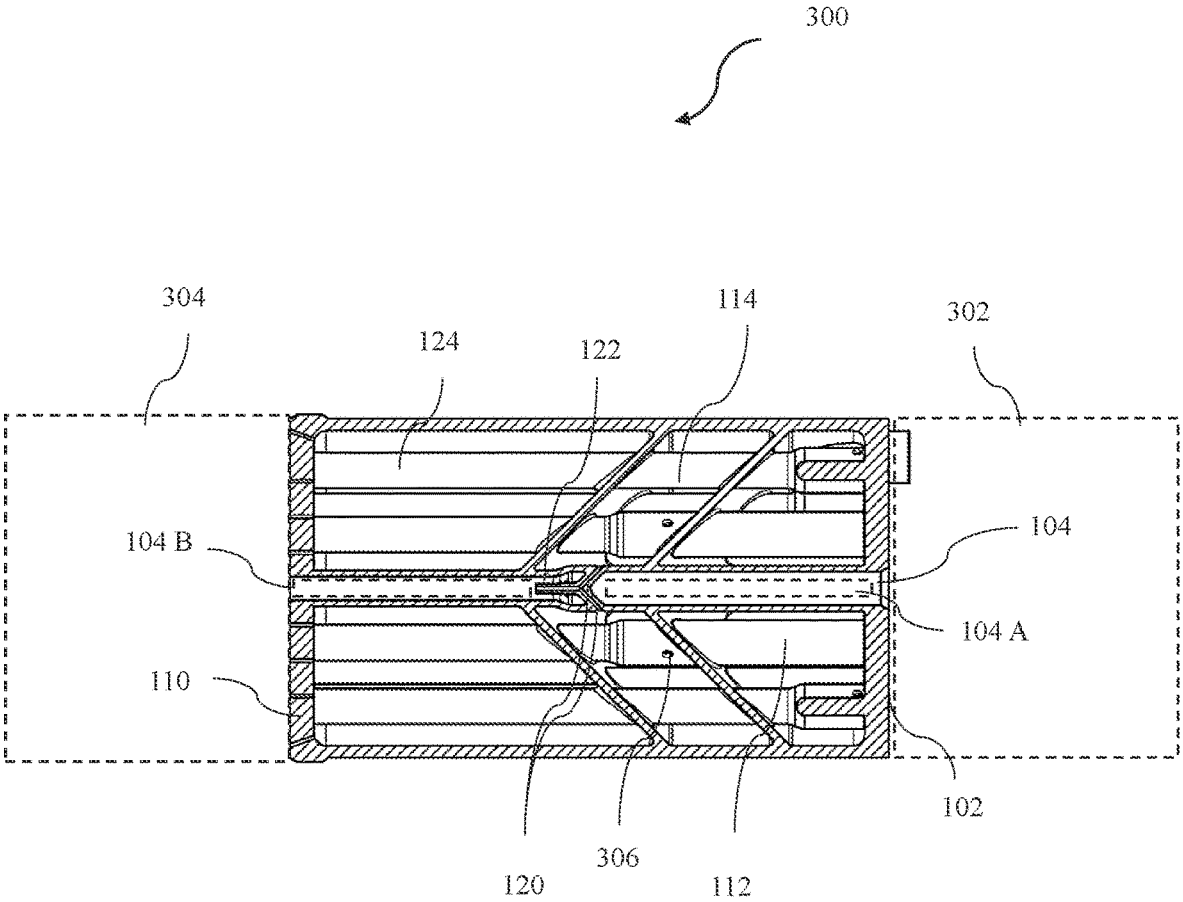
FIG. 3 is a side cross-sectional view of an exemplary multi-tube burner system for efficient mixing of fuel and air for combustion, in accordance with an embodiment of the present disclosure.

FIG. 3 is a side cross-sectional view of an exemplary multi-tube burner system for efficient mixing of fuel and air for combustion, in accordance with an embodiment of the present disclosure. In an embodiment of the present disclosure, multi-tube burner system 300 includes the air supply plenum 302, the multi-tube burner 100, and the combustor 304. In operation, the air supply plenum 302 supplies the combustion air to the multi-tube burner 100 via the set of cylindrical air holes 202 formed on the inlet surface 102 of the multi-tube burner 100. Further, the air supply section 104 A of each of the set of tubes 104 receives the combustion air from the set of cylindrical air holes 202 and supply the received combustion air from the proximal edge of the multi-tube burner 100 to the mixing section 104 B.

Furthermore, the first fuel pipe receives the fuel from the first fuel inlet 206 and supply the received fuel from the proximal edge of the multi-tube burner 100 to the first fuel plenum 112. The second fuel pipe receives the fuel from the second fuel inlet 208 and supply the received fuel from the proximal edge of the multi-tube burner 100 to the second fuel plenum 114. In an embodiment of the present disclosure, each of the first set of fuel injectors 106 receives the fuel from the first fuel plenum 112 via the pair of fuel receiving channels 120 and inject the received fuel to the mixing section 104 B via the fuel injector pin 122. The pair of fuel receiving channels 120 receive the fuel from the first plenum via the set of fuel injector entrances 306. Further, each of the second set of fuel injectors 108 receives the fuel from the second fuel plenum 114 via the pair of fuel receiving channels 120 and inject the received fuel to the mixing section 104 B via the fuel injector pin 122. In an embodiment of the present disclosure, the pair of fuel receiving channels 120 receive the fuel from the second plenum via the set of fuel injector entrances 306. In an embodiment of the present disclosure, the fuel is injected in-line with the combustion air present in the mixing section 104 B. The mixing section 104 B facilitates mixing of the combustion air and the fuel due to turbulence created by the in-line injection. Further, the set of mixing holes 212 allows egression of the combustion air and the fuel mixture to the combustor 304. For example, the air for combustion is supplied through a uniform plenum upstream (right side of plot), and the fuel and the combustion air mix in the set of tubes 104 in the middle of the multi-tube burner 100. Further, the combustion air and the fuel mixture egress into the combustor 304 where the reaction (flame) takes place to form the hot gas products. In an exemplary embodiment of the present disclosure, the hot gas products include Carbon Dioxide ($CO_2$), Oxygen ($O_2$), carbon monoxide, (CO). Nitrogen oxides ($NO_x$), Water ($H_2O$), and the like.

In an embodiment of the present disclosure, the set of cooling air tubes receive the cooling air from the air supply plenum 302 via the set of elliptical air holes 210 formed on the inlet surface 102 and supply the received cooling air from the proximal edge of the multi-tube burner 100 to the cooling air plenum 124. Further, the set of effusion cooling holes 214 allow egression of the cooling air from the cooling air plenum 124 to avoid overheating and oxidation of the front panel 110.

Various embodiments of the present disclosure provide the multi-tube burner system 300 for efficient mixing of fuel and air for combustion. In an embodiment of the present disclosure, the multi-tube burner 100 is effective for fuel air mixing and fuel flexibility. The multi-tube burner 100 is primarily focused on gaseous fuel-air combustion systems applicable to power, heat and thrust generation industrial application. In general, any gaseous combustion system requires certain range of air/fuel mixture ratio, in a confined area to be able to stabilize the flame. In the current multi-tube burner system 300, the combustion air and the fuel are fed in a distributed array of tubes exiting into the combustor 304. Thus, the fuel and combustion air are premixed and evenly distributed and at the same time. Also, the effusion cooling air surrounding the set of tubes 104 may avoid overheating towards tips of the multi-tube burner 100. Also, by having the flame distributed over large surface area, prevent the formation of hot concentration zones that could lead to higher degree of emissions. Further, the fuel and combustion air mixtures are evenly distributed on the burner front panel 110 forming small local outer recirculation zones. The mean mixture velocity can be controlled by adjusting tube size of the set of tubes 104, thus improving the flash back resistance. The effusion cooling air supply is structurally integrated into the burner front panel 110 that helps the part from being over heated. Few additional safety features are the flash back detection thermocouple, dynamic pressure sensor for detecting the pulsations and flame monitoring can be well integrated into this design. Furthermore, the multi-tube burner 100 is fabricated by the method of 3D printing to create separate fuel and air plenums in a very compact way. Further, the 3D printing also allows structural integration of the multi-tube burner 100 into a single piece of hardware addressing fuel air mixing, cooling, and flame stability, which otherwise (conventional manufacturing) requires several parts and subassemblies to get the same flow and overall performance features.

Further, the multi-tube burner 100 includes the set of tubes 104 distributed in a certain pattern, such as circumferentially or in a rectangular geometry as per the combustor geometric constrains. The set of tubes 104 mainly carny the combustion air supplied through the air supply plenum 302. In an embodiment of the present disclosure, the fuel is a gaseous fuel fed by means of the set of fuel plenums formed around the set of tubes 104 is injected by the set of fuel injector entrances 306 positioned axially at specific locations well upstream of the tube exit, giving enough time to fuel and air to mix. This also gives an additional degree of freedom to control the flame dynamics by selecting the injection locations, creating desired convective time delays. Furthermore, the integrated design of effusion cooling air not only protects the burner front panel 110 from being overheated, but also enhances the fuel air mixture to be stabilized in the shear layers formed towards the exit of the tube and the burner front panel 110. Even in the event of flash back, a flashback detection is possible by means of thermocouple that is well integrated on to burner front panel 110. The thermocouple may be exposed to high temperatures and can be used as a safety feature. In an exemplary embodiment of the present disclosure, the set of tubes 104, the set of fuel plenums, the plurality of fuel injectors, the set of cooling air tubes and their feed are integrated into a single hardware by means of 3D printing. This gives an advantage of over the existing solutions in terms of manufacturability of complex multi-tubular burner system with the above features of efficient air/fuel mixing, flash back resistance and cooling the hardware at the same time. Further, in the combustor 304, the hot gases are generated, and flame stabilizes in the very vicinity of the burner front panel 110 (exit dump plane in case of large combustion chambers). Thus, the burner front panel 110 must be cooled to avoid any overheating and oxidation of the material. This is taken care by introducing cooling air (a small portion ~10% of total combustible air taken separately from the air supply plenum 302) by means of the set of effusion cooling holes 214 distributed uniformly throughout the surface of the burner front panel 110. Thus, the life of the multi-tube burner 100 is optimized due to design of the burner front panel 110. In an embodiment of the present disclosure, integration of Thermoacoustic (TA) control measure by controlling the cooling air for the burner front panel 110. In an embodiment of the present disclosure, TA is used to represent interactions between flame and the acoustics of the combustion chamber. For certain operating conditions, these interactions lead to severe pulsations causing damage to the hardware. To mitigate or lower this risk, an inherent damping feature is developed by selecting number of the set of effusion cooling holes 214 and the volume of the cooling air plenum 124. Furthermore, the integrated inline fuel injector is optimized for mixing, life, and 3D printability. In an embodiment of the present disclosure, convective fuel time lag optimization is achieved by means of axial positioning of fuel injectors for addressing TA pulsations. In an embodiment of the present disclosure, the TA pulsations are pressure oscillations inside the chamber that can grow in amplitude for certain operating conditions causing hardware damage or deteriorate the life time of the combustor liner and the multi-tube burner 100. In an embodiment of the present disclosure, fuel staging through integrated fuel plenums i.e., the first fuel plenum 112 and the second fuel plenum 114, is optimized for fuel flexibility and acoustic damping. Furthermore, the multi-tube burner 100 includes optimization of air approach flow with integrated 3D printed inline fuel injector. In an embodiment of the present disclosure, the different dimensions, and shapes of the set of tubes 104 are created for different time lags for dynamics control. Further, burner scalability is achieved through tube sizing and their count. In an embodiment of the present disclosure, integration of the multi-tube burner system 300 for can and can-annular applications include industrial heating systems, stationary gas turbine combustion systems, aviation systems and MGT for distributed power systems. In an embodiment of the present disclosure, the can and can-annular applications are way the burners, and the combustors are arranged within the gas turbine. In the can applications, the hot gas formed in a single can is feed to the turbine. In the can-annular arrangement such single cans are arranged in a annular fashion around a rotor forming a can-annular system. In an embodiment of the present disclosure, the MGT is meant for producing the power/electricity in a small scale systems/plants that can be distributed across several regions and producing power locally.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

We claim:

1. A multi-tube burner system for efficient mixing of fuel and air for combustion, the multi-tube burner system comprising:

an air supply plenum positioned upstream of a multi-tube burner, wherein the air supply plenum is configured to supply combustion air to the multi-tube burner via a set of cylindrical air holes formed on an inlet surface of the multi-tube burner, and wherein the inlet surface is located at a proximal edge of the multi-tube burner;

the multi-tube burner positioned between the air supply plenum and a combustor, wherein the multi-tube burner comprises:

a set of tubes located inside the multi-tube burner, wherein each of the set of tubes comprise an air supply section and a mixing section, wherein the air supply section of each of the set of tubes is configured to receive the combustion air from the set of cylindrical air holes and supply the received combustion air from the proximal edge of the multi-tube burner to the mixing section, and wherein a plurality of fuel injectors are located between the air supply section and the mixing section of the set of tubes;

a set of fuel pipes configured to receive fuel from a set of fuel inlets and supply the received fuel from the proximal edge of the multi-tube burner to a set of fuel plenums;

the plurality of fuel injectors located inside the set of tubes, wherein each of the plurality of fuel injectors comprises:

a pair of fuel receiving channels configured to receive the fuel from the set of fuel plenums via a set of fuel injector entrances; and a fuel injector pin configured to inject the received fuel from the pair of fuel receiving channels to the mixing section, wherein the received fuel is injected in-line with the combustion air present in the mixing section, and wherein the mixing section facilitates mixing of the combustion air and the fuel due to in-line injection;

a burner front panel located at a distal edge of the multi-tube burner, wherein the burner front panel comprises a set of mixing holes configured to allow egression of the combustion air and the fuel mixture from the mixing section to the combustor; and the combustor positioned downstream of the multi-tube burner, wherein the combustor combusts the fuel air mixture to form one or more hot gas products.

2. The multi-tube burner system as claimed in claim 1, wherein the set of fuel pipes comprise a first fuel pipe and a second fuel pipe, wherein the set of fuel inlets comprise a first fuel inlet and a second fuel inlet, and wherein the set of fuel plenums comprise a first fuel plenum, and a second fuel plenum.

3. The multi-tube burner system as claimed in claim 2, wherein the first fuel pipe is configured to receive the fuel from the first fuel inlet and supply the received fuel from the proximal edge of the multi-tube burner to the first fuel plenum, wherein the first fuel inlet is attached with a first fuel feed pipe to receive the fuel, wherein the second fuel pipe is configured to receive the fuel from the second fuel inlet and supply the received fuel from the proximal edge of the multi-tube burner to the second fuel plenum, and wherein the second fuel inlet is attached with a second fuel feed pipe to receive the fuel.

4. The multi-tube burner system as claimed in claim 2, wherein the plurality of fuel injectors comprise a first set of fuel injectors and a second set of fuel injectors, wherein each of the first set of fuel injectors is configured to receive the fuel from the first fuel plenum via the pair of fuel receiving channels and inject the received fuel to the mixing section via the fuel injector pin, and wherein each of the second set of fuel injectors is configured to receive the fuel from the second fuel plenum via the pair of fuel receiving channels and inject the received fuel to the mixing section via the fuel injector pin.

5. The multi-tube burner system as claimed in claim 4, wherein the mixing section of one or more tubes comprising the first set of fuel injectors is longer as compared to the mixing section of the one or more tubes comprising the second set of fuel injectors, wherein an air-fuel mixture velocity may be controlled by adjusting tube size of the set of tubes.

6. The multi-tube burner system as claimed in claim 1, wherein the plurality of fuel injectors are located inside the set of tubes at different axial positions from each other for optimized mixing and convective time delay, wherein length of the mixing section and the air supply section of the set of tubes is dependent on position of the plurality of fuel injectors inside the set of tubes, wherein when one or more fuel injectors of the plurality of injectors are located in proximity of the burner front panel, length of the mixing section is decreased, and wherein when the one or more fuel injectors are located in proximity of the inlet surface, the length of the mixing section is increased.

7. The multi-tube burner system as claimed in claim 1, further comprising a set of cooling air tubes located inside the multi-tube burner, wherein the set of cooling air tubes are configured to receive cooling air from the air supply plenum via a set of elliptical air holes formed on the inlet surface and supply the received cooling air from the proximal edge of the multi-tube burner to a cooling air plenum.

8. The multi-tube burner system as claimed in claim 7, further comprising a set of effusion cooling holes formed on the burner front panel, wherein the set of effusion cooling holes allow egression of the cooling air from the cooling air plenum to avoid overheating and oxidation of the front panel.

9. The multi-tube burner system as claimed in claim 1, further comprising a set of air openings inside each of the set of tubes, wherein the set of air openings are formed between the pair of fuel receiving channels and the fuel injector pin, and wherein the set of air openings allow the combustion air to move from the air supply section to the mixing section.

10. The multi-tube burner system as claimed in claim 1, wherein the multi-tube burner is fabricated by the method of 3D printing.

* * * * *